US009386674B2

(12) United States Patent
Putterman et al.

(10) Patent No.: US 9,386,674 B2
(45) Date of Patent: Jul. 5, 2016

(54) MECHANOLUMINESCENT X-RAY GENERATOR

(71) Applicant: The Regents of the University of California, Oakland, CA (US)

(72) Inventors: Seth J. Putterman, Malibu, CA (US); Carlos Camara, Venice, CA (US); Juan V. Escobar, Venice, CA (US); Jonathan Hird, Cambridge (GB)

(73) Assignee: The Regents of the University of California, Oakland, CA (US)

( * ) Notice: Subject to any disclaimer, the term of this patent is extended or adjusted under 35 U.S.C. 154(b) by 245 days.

(21) Appl. No.: 14/152,770

(22) Filed: Jan. 10, 2014

(65) Prior Publication Data

US 2014/0226790 A1 Aug. 14, 2014

Related U.S. Application Data

(62) Division of application No. 12/863,728, filed as application No. PCT/US2009/033787 on Feb. 11, 2009, now Pat. No. 8,699,666.

(60) Provisional application No. 61/064,020, filed on Feb. 11, 2008, provisional application No. 61/136,961, filed on Oct. 17, 2008.

(51) Int. Cl.
*H05G 2/00* (2006.01)

(52) U.S. Cl.
CPC ..... *H05G 2/00* (2013.01)

(58) Field of Classification Search
CPC ..... A61K 8/19; A61K 2800/436; A61K 8/25; A61K 8/26; A61K 2800/47; H05G 2/00
See application file for complete search history.

(56) References Cited

U.S. PATENT DOCUMENTS

| | | | |
|---|---|---|---|
| 5,665,969 | A | 9/1997 | Beusch |
| 6,476,406 | B1 | 11/2002 | Struye et al. |
| 6,493,423 | B1 | 12/2002 | Bisschops |
| 6,668,039 | B2 | 12/2003 | Shepard et al. |
| 2007/0086624 | A1 | 4/2007 | Breed et al. |
| 2009/0050847 | A1 | 2/2009 | Xu et al. |

FOREIGN PATENT DOCUMENTS

SU 1149331 A1 4/1985

OTHER PUBLICATIONS

Kluev et al., "Gas-discharge phenomena, accompanying the process of breaking an adhesion contact in vacuum," IAS Annual Meeting, 1977, pp. 596-598.

(Continued)

*Primary Examiner* — Hoon Song
(74) *Attorney, Agent, or Firm* — Venable LLP; Henry J. Daley; Laura G. Remus

(57) ABSTRACT

A device for generating x-rays has an enclosing vessel having a structure suitable to provide an enclosed space at a predetermined fluid pressure, wherein the enclosing vessel has a window portion and a shielding portion in which the shielding portion is more optically dense to x-rays than the window portion; a mechanoluminescent component disposed at least partially within the enclosing vessel; and a mechanical assembly connected to the mechanoluminescent component. The mechanical assembly provides mechanical energy to the mechanoluminescent component while in operation, and at least some of the mechanical energy when provided to the mechanoluminescent component by the mechanical assembly is converted to x-rays.

9 Claims, 13 Drawing Sheets

(56) References Cited

OTHER PUBLICATIONS

International Search Report and Written Opinion for PCT/US2009/033787.

Keiji Ohara et al., "Light emission due to peeling of polymer films from various substrates", Journal of Applied Polymer Science, vol. 14, No. 8, Aug. 1, 1970, pp. 2079-2095.

Nakayama K. et al., "Tribomession of charged particles and photons from solid surfaces during frictional damage", Journal of Physics D. Applied Physics, vol. 25, No. 2, Feb. 14, 1992, pp. 303-308.

V.A. Klyuev, et al., "The effect of air pressure on the parameters of x-ray emission accompanying adhesive and cohesive breaking solids", Sov. Phys. Tech. Phys., vol. 34, Mar. 1989, pp. 361-364.

Nishitani et al., "STM tip-enhanced photoluminescence from porphyrin film", Surface Science, North-Holland Publishing Co., vol. 601, No. 17, Aug. 23, 2007, pp. 3601-3604.

Supplementary European Search Report dated Feb. 7, 2012.

MECHANOLUMINESCENT X-RAY GENERATOR

CROSS-REFERENCE TO RELATED APPLICATION

This application is a divisional of U.S. application Ser. No. 12/863,728 filed Sep. 1, 2010, the entire contents of which are hereby incorporated by reference. This application claims priority to U.S. Provisional Application No. 61/064,020 filed Feb. 11, 2008 and U.S. Provisional Application No. 61/136,961 filed Oct. 17, 2008, the entire contents of which are hereby incorporated by reference, and is a U.S. national stage application under 35 U.S.C. §371 of PCT/US2009/033787 filed Feb. 11, 2009, the entire contents of which are incorporated herein by reference.

This invention was made with Government support under HR0011-07-1-0010, awarded by the U.S. Department of Defense, Defense Advanced Research Projects Agency. The Government has certain rights in the invention.

BACKGROUND

1. Field of Invention

The current invention relates to radiation and x-ray sources, devices using the radiation and x-ray sources and methods of use; and more particularly to mechanically operated radiation and x-ray sources, devices using the mechanically operated radiation and x-ray sources and methods of use.

2. Discussion of Related Art

When a continuous medium is driven far from equilibrium, nonlinear processes can lead to strong concentrations in the energy density. Sonoluminescence (Putterman, S. J. Weninger, K. R. Sonoluminescence: how bubbles turn sound into light. *Annual Rev. of Fluid Mech.* 32, 445 (2000)) provides an example where acoustic energy concentrates by 12 orders of magnitude to generate sub-nanosecond flashes of ultraviolet light. Charge separation at contacting surfaces (Harper, W. R. *Contact and Frictional Electrification* (Laplacian Press, Morgan Hill, Calif., 1998); Deryagin, B. V. Krotova, N. A. Smilga, V. P. *Adhesion of Solids* (Consultants bureau, New York, 1978)) is another example of a process which funnels diffuse mechanical energy into high energy emission. Lightning (Black, R. A. Hallett, J. The mystery of cloud electrification. *American Scientist,* 86, 526 (1998)) for it has been shown to generate x-rays with energies above 10 keV (Dwyer, J. R. et al. Energetic radiation produced during rocket-triggered lightning. *Science* 299, 694-697 (2003)). Although triboelectrification is important for many natural and industrial processes, its physical explanation is still debated (Black, R. A. Hallett, J. The mystery of cloud electrification. *American Scientist,* 86, 526 (1998); McCarty, L. Whitesides, G. M. Electrostatic charging due to separation of ions at interfaces: contact electrification of ionic electrets, *Angew. Chem. Int. Ed.* 47, 2188-2207 (2008)).

By peeling pressure sensitive adhesive tape, one can realize an everyday example of tribocharging and triboluminescence (Walton, A. J. Triboluminescence. *Adv. in Phys.* 26, 887-948 (1977)); the emission of visible light. Tape provides a particularly interesting example of these phenomena because it has been claimed that the fundamental energy which holds tape to a surface is provided by the Van der Waals interaction (Gay, C. Leibler, L. Theory of tackiness. *Phys. Rev. Lett.* 82, 936-939 (1999)). This energy—the weakest in chemistry—is almost 100 times smaller than the energy required for generating a visible photon, yet, as demonstrated by E. Newton Harvey (Harvey, N. E. The Luminescence of adhesive tape. *Science New Series* 89, 460-461 (1939)) in 1939, light emission from peeling tape can be seen with the unaided eye. That even more energetic processes were at play had already been suggested in 1930 by Obreimoff (Obreimoff, J. W. The splitting strength of mica. *Proc. Roy. Soc.* 290-297 (1930)) who observed that when mica is split under vacuum "the glass of the vessel fluoresces like an X-ray bulb". This insight motivated Karasev (Karasev, V. V. Krotova, N. A. Deryagin, B. W. Study of electronic emission during the stripping of a layer of high polymer from glass in a vacuum. *Dolk. Akad. Nauk SSR* 88, 777 (1953). [Engl. Trans. NSF-tr-28; July 1953 Columbia University Russian Science Translation Project]) to suggest that peeling tape can emit electrons. However, despite such observations of unexpected physical effects over many years, there remains a need to exploit such phenomena for useful devices and methods.

SUMMARY

A device for generating x-rays according to an embodiment of the current invention has an enclosing vessel having a structure suitable to provide an enclosed space at a predetermined fluid pressure, wherein the enclosing vessel has a window portion and a shielding portion in which the shielding portion is more optically dense to x-rays than the window portion; a mechanoluminescent component disposed at least partially within the enclosing vessel; and a mechanical assembly connected to the mechanoluminescent component. The mechanical assembly provides mechanical energy to the mechanoluminescent component while in operation, and at least some of the mechanical energy when provided to the mechanoluminescent component by the mechanical assembly is converted to x-rays.

A radiation source according to an embodiment of the current invention has a contact element, a surface element arranged proximate the contact element, and a mechanical assembly operatively connected to at least one of the contact element and the surface element. The mechanically assembly is operable to at least separate and bring to contact the contact element from the surface element, and at least some mechanical energy is supplied from the mechanical assembly while in operation to generate radiation while the contact element and the surface element move relative to each other. The radiation source has a maximum dimension less than about 1 cm.

An x-ray device according to some embodiments of the current invention have a mechanoluminescent x-ray source.

BRIEF DESCRIPTION OF THE DRAWINGS

Further objectives and advantages will become apparent from a consideration of the description, drawings, and examples.

FIG. 3A is a photograph of the simultaneous emission of triboluminescence [red line] and scintillation of a phosphor screen sensitive to electron impacts with energies in excess of 500 eV [under a pressure of 150 mtorr of Neon]. FIG. 3B is a photograph of the same apparatus as in FIG. 3A [under a pressure of $10^{-3}$ torr] illuminated entirely by means of scintillation. FIG. 3C is a schematic illustration the apparatus used to measure peeling force according to an embodiment of the current invention.

In FIG. 4A, the left axis is the force for peeling tape at 3 cm/s in a $10^{-3}$ torr vacuum [black] and at 1 atmosphere [dashed green]. He right axis is the x-ray signal [blue trace] from an Amptek detector with tantalum foil shield. The rf antenna signal is the red upper trace. FIG. 4B shows correlation of liquid scintillator [blue] with rf [red] from peeling tape. The rise time of the scintillator is about 5 ns for the tape signal [blue] and cosmic ray calibration [dashed blue]. The dashed red line is an antenna calibration signal [Methods].

FIG. 9A is a photograph of the capacitor in the set-up used to take the x-ray image, FIG. 9B is the x-ray image of the capacitor. The tape was under a pressure of $1\times10^{-3}$ torr of air and the peel speed used was 20 cm/s. The tape was unwinding from right to left. The capacitor was placed 1 cm from the tape outside the vacuum chamber over a ¼" plastic window. The x-ray image is a 5 s exposure on a Hamamatsu oral x-ray camera [S8985-02] placed over the capacitor. This detector has 20×20 μm pixels, however for the x-ray images presented here a 4 pixel binning was used, resulting in an effective resolution of 40×40 μm. This device is 40% efficient at capturing 30 keV photons. The horizontal line apparent in the x-ray image is an x-ray shadow of the tape

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited herein are incorporated by reference as if each had been individually incorporated.

The term "light" as used herein is intended to have a broad meaning to include electromagnetic radiation irrespective of wavelength. For example the term "light" can include, but is not limited to, infrared, visible, ultraviolet and other wavelength regions of the electromagnetic spectrum. The terms mechanoluminescent, triboluminescent, fractoluminescent and flexoluminescent are intended to have a broad meaning in that they emit electromagnetic radiation as a result of a mechanical operation. The emitted electromagnetic radiation can, but does not necessarily include visible light. In some cases, it can include a broad spectrum of electromagnetic radiation extending, for example, from RF, infrared visible, ultraviolet, x-ray and beyond regions of the electromagnetic spectrum. However, in other cases, the emitted spectra may be narrower and/or in other energy regions. The term "x-rays" as used herein is intended to include photons that have energies within the range of about 100 eV to about 500 keV.

Figure 1A:
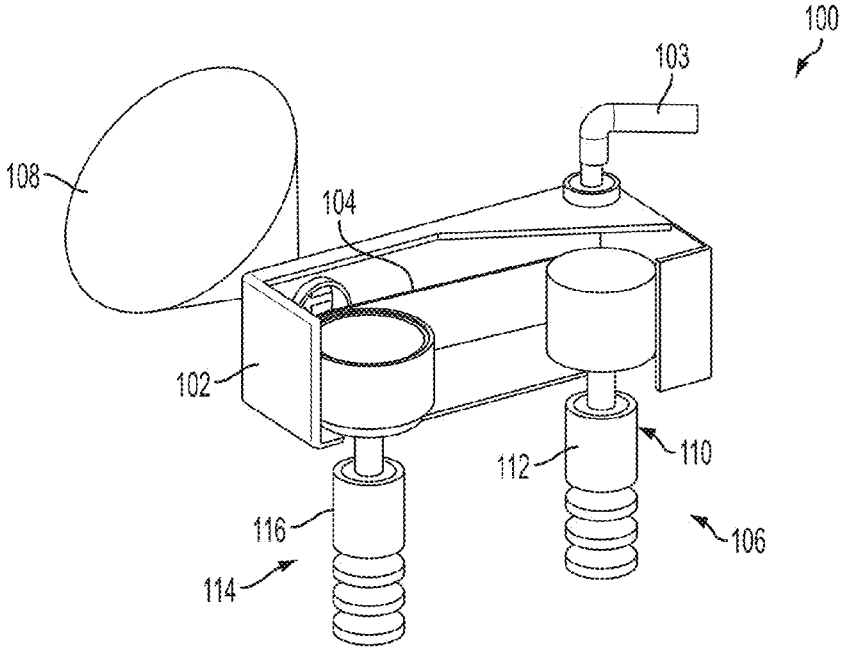
FIGS. 1A and 1B are schematic illustrations of a device for generating x-rays according to an embodiment of the current invention.
Figure 1B:
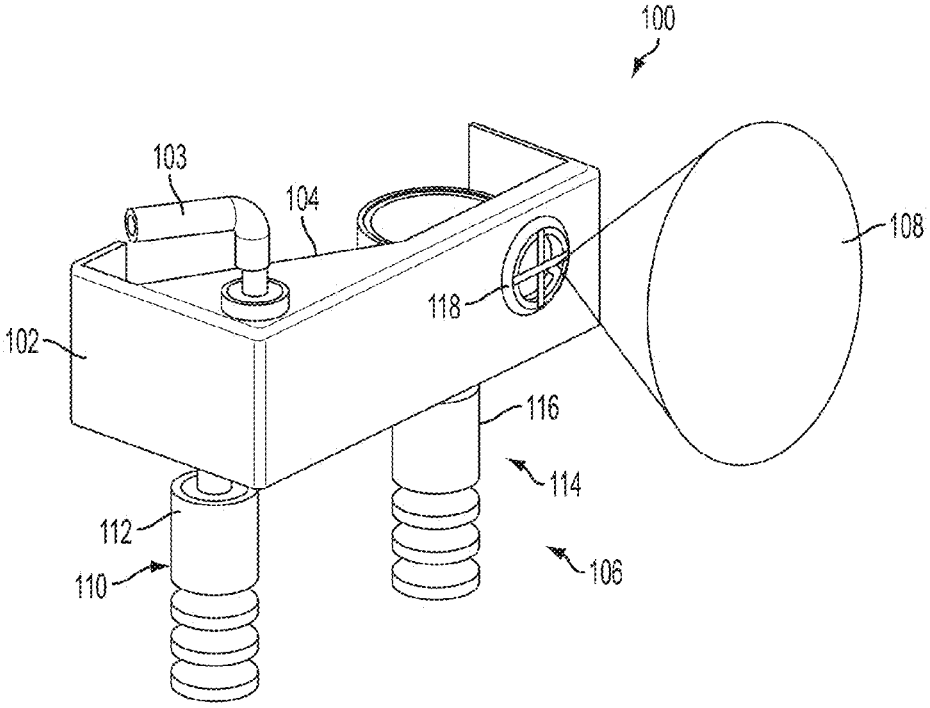

FIGS. 1A and 1B provide schematic illustrations of a device for generating x-rays 100 according to an embodiment of the current invention. The device 100 has an enclosing vessel 102 having a structure suitable to provide an enclosed space at a predetermined fluid pressure. The device 100 is shown in back and front perspective views in FIGS. 1A and 1B, respectively, with the enclosing vessel 102 partially cut away to show interior structures. The enclosing vessel 102 is substantially fully enclosed such that it can assist with the control of the physical conditions within the enclosing vessel 102. For example, the enclosing vessel 102 can be evacuated so that the enclosed space has a fluid pressure, which can be a gas pressure, less than atmospheric pressure. The enclosing vessel 102 can also assist in controlling other environmental conditions such as humidity and/or temperature, for example. Furthermore, one could introduce a fluid into the enclosing vessel 102 such as, but not limited to, a gas or a gas mixture which could be at a pressure less than, greater than or substantially equal to atmospheric pressure at an operating temperature in some embodiments of the current invention.

In some embodiments, a gas pressure within the enclosing vessel 102 that is less than about 0.1 torr has been found to be suitable for some applications. In some embodiments, it has been found to be suitable to introduce Helium, Hydrogen, Nitrogen, Argon, or Sulfur Hexafluoride, or any combination thereof, gas into the enclosing vessel 102. However, other gases and/or combinations could be added depending on the particular application without departing from the general concepts of this invention. The device for generating x-rays 100 may also have at least one fluid port 103 to evacuate and/or introduce a fluid into the chamber provided by the enclosing vessel 102.

The device for generating x-rays 100 also has a mechanoluminescent component 104 disposed at least partially within the enclosing vessel 100. In FIGS. 1A and 1B, the mechanoluminescent component 104 is contained entirely within the enclosing vessel 102, which is shown in a cut away view. However, the broad concepts of the current invention are not limited to only that type of configuration. The device for generating x-rays 100 also has a mechanical assembly 106 connected to the mechanoluminescent component 104. The mechanical assembly 106 is operable to provide mechanical energy to the mechanoluminescent component 104 such that at least some of the mechanical energy, when provided, is converted to x-rays 108. The mechanoluminescent component 104 can include at least one of a triboluminescent or fractoluminescent element according to some embodiments of the current invention. The triboluminescent element emits a broad spectrum of electromagnetic radiation when it has surfaces rubbing against each other, peeling apart from each other, striking each other and/or separating from each other in some embodiments of the current invention. The fractoluminescent element can be synonymous to the triboluminescent element in some embodiments, but can also include a solid material fracturing, for example. The general concepts of the current invention are not limited to specific mechanoluminescent elements, which may be selected according to the particular application.

In the embodiment of FIGS. 1A and 1B, the mechanoluminescent component 104 is a pressure sensitive adhesive tape. In some embodiments of the current invention, the mechanoluminescent component 104 can be pressure sensitive adhesive tape that has an adhesive having a vapor pressure suitable for use under the preselected fluid pressure within the enclosing vessel 102. In some embodiments, the mechanoluminescent component 104 can be pressure sensitive adhesive tape that has a metal added to its composition. Chemical elements with higher numbers of protons can act to increase the energies of the generated photons. Chemical elements with high numbers of protons can also be included in other structures close to the region where radiation is generated to lead to the generation of x-rays with increased energies. In some embodiments, the mechanoluminescent component 104 can be pressure sensitive adhesive tape that has an acrylic adhesive on a polyethylene tape, for example, SCOTCH tape. In some embodiments, the mechanoluminescent component 104 can be pressure sensitive adhesive tape that is arranged on a roll-to-roll assembly so that a portion of the tape can be unrolled from a first spool and rolled onto a second spool as is shown schematically in FIGS. 1A and 1B. However, the broad concepts of the current invention are not limited to this particular arrangement.

The mechanical assembly 106 includes at least one of a manually operable drive system or a motorized drive system 110 connected to at least one of the first and second spools on which the adhesive tape is wound. The manually operable drive system or the motorized drive system 110 is operable to cause tape to be wound onto one of the spools from the other of the spools. The other spool can be freely rotatable or also connected to a drive assembly according to some embodiments of the current invention. In the example shown, the mechanical assembly includes an electrical motor 112. However, in other embodiments, it could be hand operable, which may include a crank or a knob, for example. The mechanical assembly 106 can also include a second manually operable drive system or a second motorized drive system 114 connected to at least one of the first and second spools to permit the adhesive tape to be unrolled from the second spool and rolled onto the first spool to provide reversible operation of the roll-to-roll assembly. In the example of FIGS. 1A and 1B, the manually operable drive system or a second motorized drive system 114 is a motorized drive system that has a second motor 116.

The device for generating x-rays 100 can also include a window portion 118 in the enclosing vessel 102 such that the enclosing vessel 102 is more optically dense to x-rays in directions other than the window portion 118. This can provide shielding from x-rays for the user while permitting x-rays to pass through the window for desired applications.

Figure 2:
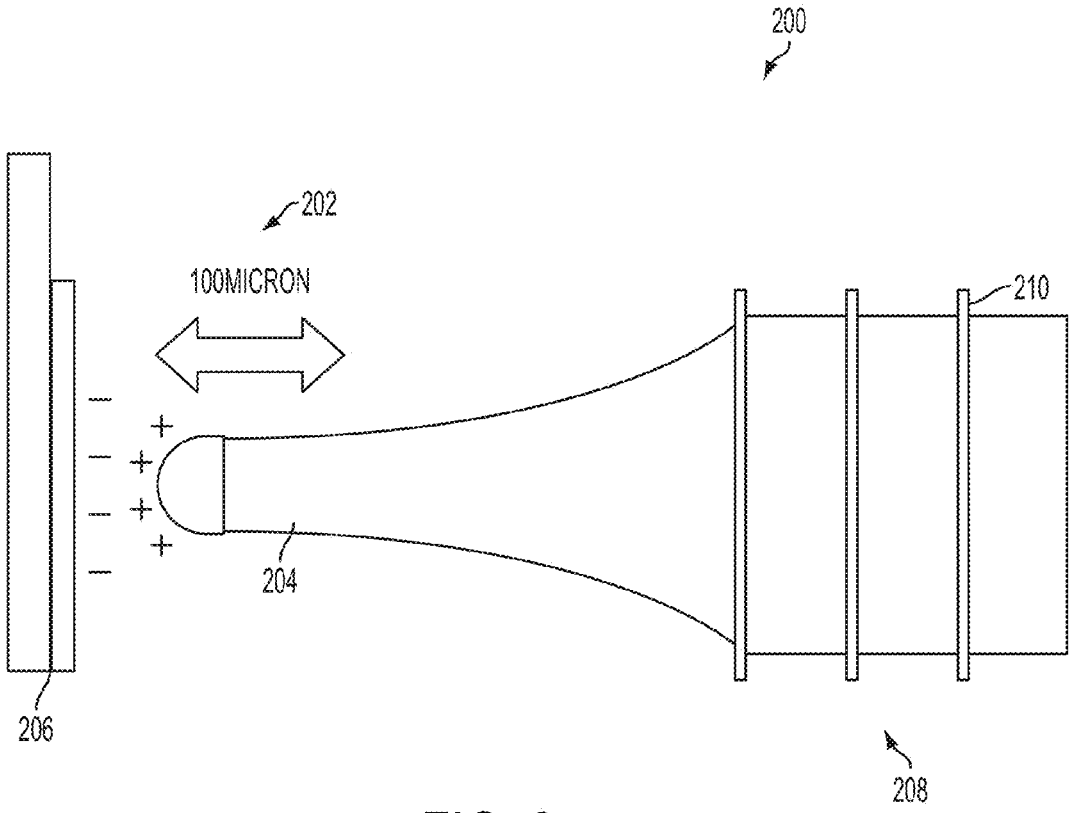
FIG. 2 is schematic illustrations of a device for generating x-rays according to another embodiment of the current invention.

FIG. 2 is a schematic illustration of another embodiment of a device for generating radiation 200 according to an embodiment of the current invention. The device for generating radiation 200 can include a mechanoluminescent component 202 that has a contact element 204 constructed and arranged to be brought into contact with and to be separated from a surface element 206. The device for generating radiation 200 can include a mechanical assembly 208 that includes a piezoelectric transducer 210 mechanically connected to the contact element 204 to cause the contact element 204 to be brought into contact with the surface element 206 and to be separated from the surface element 206 in a direction substantially orthogonal to the surface element 206 at a point of contact. The contact of the surface element 206 to the contact element 204 can be enhanced by mechanical motion parallel to the surface element 206. Although not shown in FIG. 2, the device for generating radiation 200 can include an enclosing structure to control the local environment. The devices for generating x-rays 100 and radiation 200 are both scalable in size. The device for generating x-rays 100, for example, can be scaled by using thicker or thinner tape. It can conceivably be scaled to very large sizes, for example, such as using tape or similar structures that can be on the scale on millimeters, centimeters or even several meters wide. The device for generating radiation 200, for example, can be scaled down to a size on the scale of millimeters, microns, or even sub micron size. The device for generating radiation 200 can be incorporated in a surgical device such as a catheter or an implantable device in some embodiments according to the current invention. The device for generating radiation 200 can generate charged particle radiation, such as electrons and/or ions, and/or electromagnetic radiation such as, but not limited to, x-rays.

According to some embodiments of the current invention, an x-ray device includes a mechanoluminescent x-ray source. The mechanoluminescent x-ray source can be, but is not limited to, the device for generating x-rays 100 and/or 200. The x-ray device can be, but is not limited to, an x-ray communication device and/or system, an x-ray imaging device, and x-ray sensor system to indicate a change in an environmental condition, a spectroscopic system to determine the composition of samples and/or diagnostic or medical treatment systems. A couple of these embodiments will be described in some more detail below, however the general concepts of the current invention are not limited to only these examples of x-ray devices according to some embodiments of the current invention.

Figures 3A, 3B, 3C:
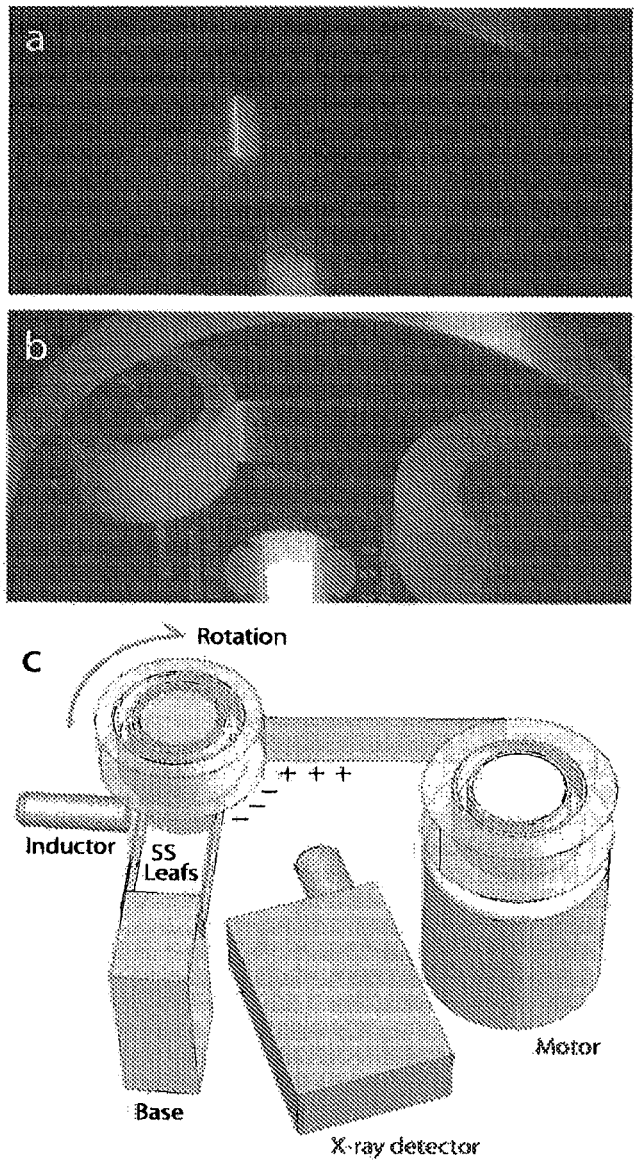
FIGS. 3A-3C is an example device for generating x-rays according to an embodiment of the current invention.

The following describes some further examples as well as presenting some data taken for some particular embodiments. The simultaneous emission of visible and x-ray photons from peeling tape is shown in FIG. 3A where the blue glow is due to a scintillator responsive to x-ray energies and the red patch near the peel point is the neon enhanced triboluminescence reported by Harvey (Harvey, N. E. The Luminescence of adhesive tape. *Science New Series* 89, 460-461 (1939)). FIG. 3B demonstrates that when the vacuum pressure is $10^{-3}$ torr the high energy emission is so strong that the photo is illuminated entirely with scintillations.

Motivated by these photos we interpret triboluminescence (Walton, A. J. Triboluminescence. *Adv. in Phys.* 26, 887-948 (1977)), a phenomenon known for centuries, as being part of an energy density focusing process that can extend four orders of magnitude beyond visible light to x-ray photons. To learn about the processes at play in peeling tape, we employ efficient high speed x-ray detection equipment. Our measurements indicate that the scintillations in FIG. 3B contain nanosecond long x-ray pulses whose emission is correlated with radio frequency (rf) pulses and slips in the force required to peel the pressure sensitive adhesive tape. Furthermore, the short duration of these x-ray pulses indicates that the emission originates from a sub-millimeter sized region near the vertex of peeling with a transient charge density [$\sim 10^{12}$ e/cm$^2$] that is over an order of magnitude greater than is measured in typical tribocharging systems.

Figures 4A, 4B:
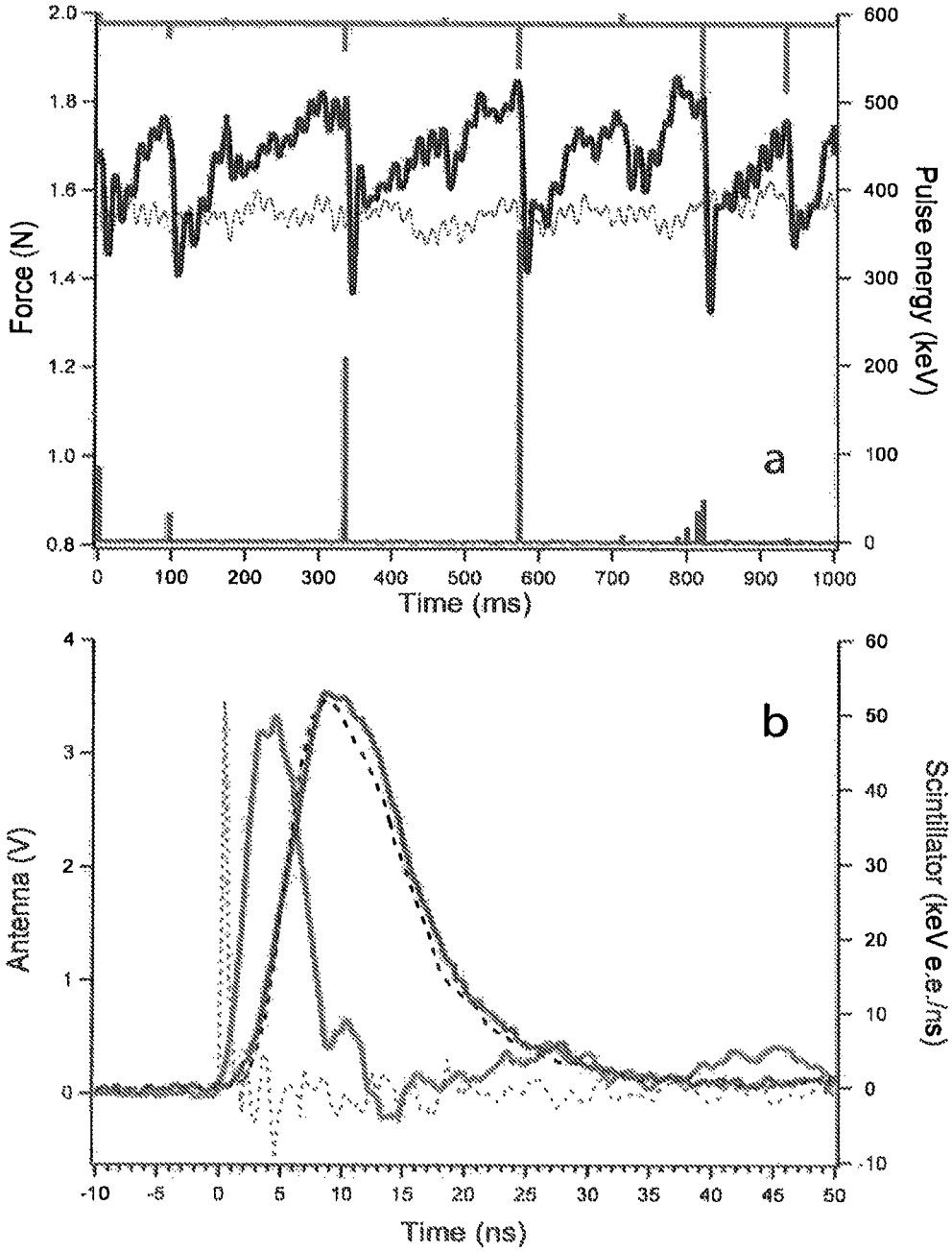
FIGS. 4A and 4B show correlation between x-rays, force and radio frequency (rf).

The correlation between x-ray emission and peeling force in a $10^{-3}$ torr vacuum is displayed in FIG. 4A. As the force [black trace] increases above its value under an applied pressure of one atmosphere (Zosel, A. Adhesive failure and deformation behavior of polymers *J. Adhesion* 30, 135-149 (1989)) [dashed green trace] emissions with x-ray energies are recorded [blue trace]. No x-ray emission has been observed at one atmosphere. The slips are also correlated with a signal detected by a radio frequency antenna (Budakian, R. Weninger, K. Hiller, R. A. Putterman, S. J. Picosecond discharges and stickslip friction at a moving meniscus of mercury on glass. *Nature* 391, 266-268 (1997)) [red trace]. FIG. 4B shows sub-ns resolved data used to correlate radio frequency emission from peeling tape with liquid scintillator signals [blue trace]. The solid red and dashed red traces are the response of the antenna to signals generated respectively by peeling tape and by the relative motion of mercury and glass where rf discharges due to tribo-charging are known to occur (Budakian et al.).

Figure 5:
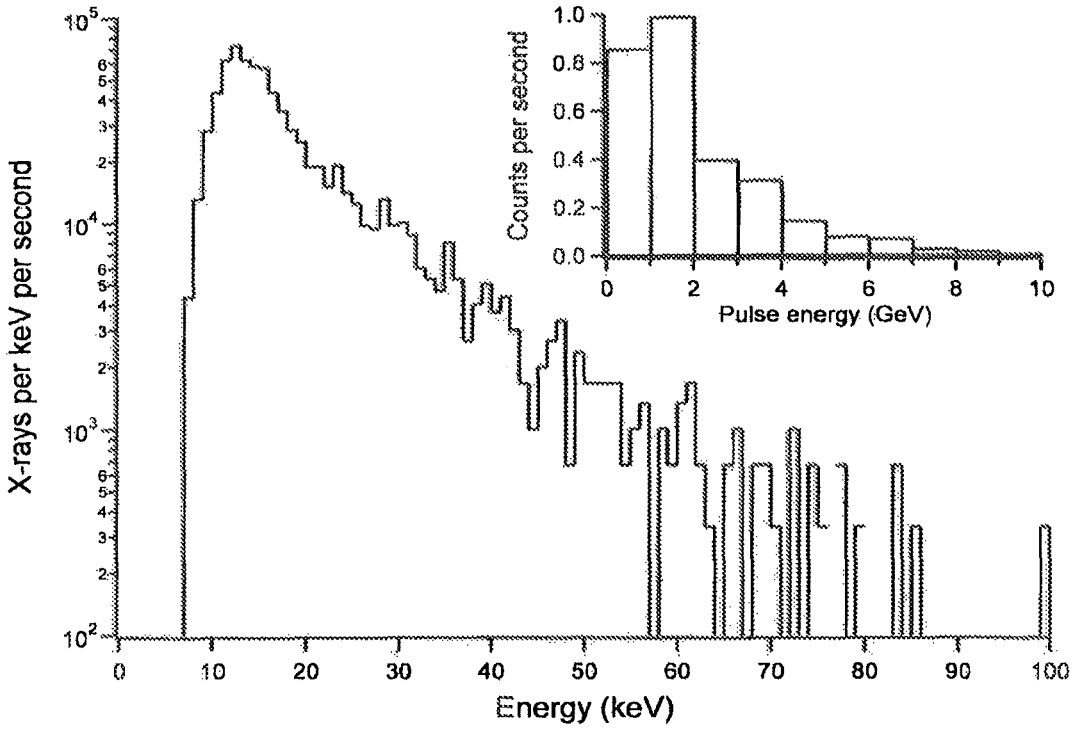
FIG. 5 shows the spectrum of x-ray energies from peeling one roll of tape according to an embodiment of the current invention. The peel speed was between 3 cm/s and 3.6 cm/s at $10^{-3}$ torr of air. Data was acquired with the Amptek CdTe detector. Inset Energies for ns pulses out to 10 GeV for the same run taken with the Amptek 3-Stack detector [Methods].
Figure 6:
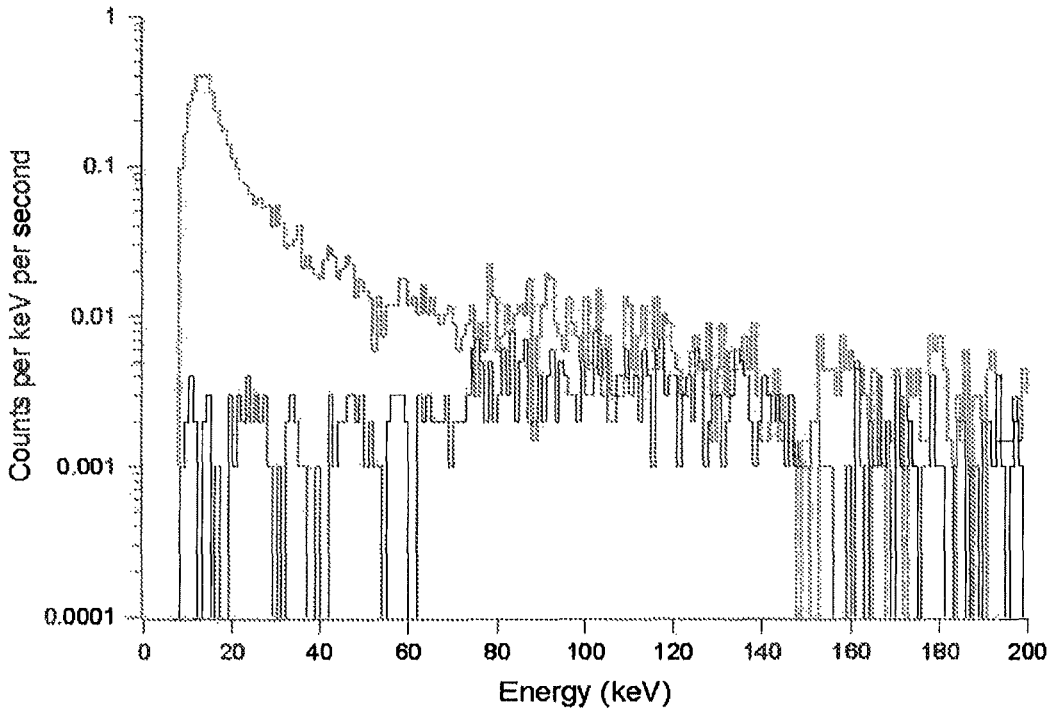
FIG. 6 shows the spectrum of x-ray energies from peeling one roll of tape. Peel speed was between 3 cm/s and 3.6 cm/s at $10^{-3}$ torr of air. Data was taken with an Amptek XR-100 3-Stack detector, unshielded, placed at 56 cm from the tape, looking through a ¼" plastic window. The total data acquired was 679 s [red trace]. The background [black trace] was acquired for 1000 s.

The data in FIG. 4A was acquired with tantalum foil shielding the window of a solid state x-ray detector. This attenuates x-rays with energies below about 20 keV in favour of larger events synchronized to the slips. The spectrum (Klyuev, V. Toporov, A. YuP Alev, A. D. Chalykh, A. E. Lipson, A. G. The effect of air pressure on the parameters of x-ray emission accompanying adhesive and cohesive breaking of solids. *Sov. Phys. Tech. Phys.* 34, 361-364 (1989)) of all x-ray photons emitted from the peeling tape as recorded by an unshielded solid state detector is shown in FIGS. 5 and 6. In order to minimize pile-up of photons the detector was placed 69 cm from the peeling vertex of the tape, so the plotted data has a solid angle correction of 120,000 relative to the raw data [see Methods]. The total energy in the bursts which accompany the slips was obtained from events that were 3-way coincident between a solid state detector, the liquid scintillator, and the Characteristic rf pulse [FIG. 4B]. The inset to FIG. 5 shows the spectrum of x-ray burst energies which accompany slip events out to 10 GeV. These pulses occur at a rate in excess of one Hz and their time traces Pill within the 5 ns resolution of the liquid scintillator detectors. The spectrum does not change significantly during ten re-windings of a given roll of tape.

According to studies of controlled vacuum discharges (Baksht, R. B. Vavilov, S. P. Urbayaev, M. N. Duration of the x-ray emission arising in a vacuum discharge. *Izvestiya Uchebnykh Zavedenii, Fizika* 2, 140-141 (1973)), the rise time of the current is the width of the x-ray flash. From the red trace of FIG. 4B this implies that the width of the coincident x-ray pulses is ~1-2 ns. Thus a typical 2 ns burst with 2 GeV energy has a peak power of over 100 mW. These bursts which occur more than once per second contain over 50% of the total energy radiated as x-ray photons above 10 KeV. This includes x-ray photons synchronized to slip events as well as "precursor" x-rays emitted between slips. According to FIG. 5 the total emission is $1.2\times10^{10}$ eV/s or 2 nW average x-ray power.

Motivated by the long standing phenomenology of tribocharging (Harper, W. R. *Contact and Frictional Electrification* (Laplacian Press, Morgan Hill, Calif., 1998); McCarty, L. Whitesides, G. M. Electrostatic charging due to separation of ions at interfaces: contact electrification of ionic electrets, *Angew. Chem. Int. Ed.* 47, 2188-2207 (2008)), we propose the following sequence of events: as the tape peels the sticky acrylic adhesive becomes positive and the polyethylene roll becomes negative so that electric fields build up to values which trigger discharges. At a reduced pressure, the discharges accelerate electrons to energies which generate Bremsstrahlung x-rays when they strike the positive side of the tape. (Note, however, that the current invention is not limited to whether this theoretical explanation is indeed correct.) To elucidate the current of high-energy electrons that drive this process we compared FIG. 5 to published scattering data (Chervenak, J. G. Liuzzi, A. Experimental thick target Bremsstrahlung spectra from electrons in the range 10-30 keV. *Phys. Rev. A.* 12, 26-33 (1975)). A strand of adhesive tape is thick compared to an electron absorption length [the Krarners limit] but not so thick as to absorb all the x-rays. (liven that the difference is not significant, here we take the thick target limit. The peak near 15 key with $3\times10^5$ x-rays per second is therefore due to electrons with energies of about 30 keV which then create an integrated Bremsstrahlung x-ray spectrum with an efficiency of $10^{-4}$. Only 5% of these x-rays are above 15 keV. These factors imply a discharge current of $6\times10^{10}$ electrons per second, which corresponds to an average electric power of 0.2 mW; five orders of magnitude higher than the integrated x-ray spectra displayed in FIG. 5. As the 2 cm wide tape peels at 3 cm/s, the average density of charge separated and discharged is $10^{10}$ e/cm$^2$, which is consistent with known tribocharging processes (McCarty, L. Whitesides, G. M. Electrostatic charging due to separation of ions at interfaces: contact electrification of ionic electrets. *Angew. Chem. Int. Ed.* 47, 2188-2207 (2008)).

The x-ray bursts require charge densities that are substantially larger than those which characterize the average tribocharging discussed above. For a Townsend discharge (Raizer, Y. *Gas Discharge Physics* (Springer, Berlin Germany, 1991), pp. 132), the bottleneck is the time it takes an ion to cross a gap of length l times the number of round trips [~10] needed to build up an avalanche. For a hydrogen ion moving with a velocity $v=\sqrt{2eV/m}$ in a potential V=30 kV a pulse width $\Delta t=10\ l/v\sim1$ ns implies a characteristic length l~300 μm which in turn implies an accelerating field E~V/l~$10^6$ V/cm and a charge density $\sigma \sim \epsilon_0 E$ of $7\times10^{11}$ e/cm$^2$ (Graf von Harrach, H. Chapman, B. N. Charge effects in thin film adhesion. *Thin Sol. Films* 12, 157-161 (1972)). According to an alternative theory, the discharge consists of an explosive plasma emission (Mesyats, G. A. Ectons and their role in plasma processes. *Plasma Phys. Control Fusion* 47, A109-A151 (2005)). The characteristic time for the current to flow is determined by the time it takes the plasma moving at $2\times10^6$ cm/s to expand across the gap (Mesyats; Baksht, R. B. Vavilov, S. P. Urbayaev, M. N. Duration of the x-ray emission arising in a vacuum discharge. *Izvestiya Uchebnykh Zavedenii, Fizika* 2, 140-141 (1973)). It has been established experimentally that the duration of the pulse increases linearly with the gap size with proportionality factor of 5 ns/100 μm (Baksht). This implies a gap l~10's of microns and the corresponding field of $10^7$ V/cm requires a charge density of $7\times10^{12}$ e/cm$^2$. An image of the x-ray emission region could distinguish between the various theories.

When the tape is peeled, part of the energy supplied is converted to elastic deformation of the tape (Kendall, K., Thin-film peeling-the elastic term. *J. Phys, D* 8, 1449-1453 (1975)), cavitation (Chikina, I. Gay, C. Cavitation in adhesives. *Phys. Rev. Lett.* 85, 4546-4549 (2000)) and filamentation (Urahama, Y. Effect of peel load on stringiness phenomena and peel speed of pressure-sensitive adhesive tape. *J. of Adhesion,* 31, 47-58 (1989)) of the adhesive, acoustic emission (Rumi De. Ananthakrisbna, G. Dynamics of the peel front and the nature of acoustic emission during peeling of an adhesive tape, *Phys. Rev. Lett.* 97, 165503-06, (2006)), visible light (Harvey, N. E. The Luminescence of adhesive tape. *Science New Series* 89, 460-461 (1939); Miura, T. Chini, M. Bennewitz, R. Forces, charges, and light emission during the rupture of adhesive contacts. *J. of Appl. Phys.* 102, 103509 (2007)) and high-energy electron emission (Karasev, V. V. Krotova, N. A. Deryagin, B. W. Study of electronic emission during the stripping of a layer of high polymer from glass in a vacuum. *Dolk. Akad. Nauk. SSR* 88, 777 (1953). [Engl. Trans. NSF-tr-28; July 1953 Columbia University Russian Science Translation Project]). According to FIG. 5 the power required to peel the tape at a speed of 3 cm/s is 50 mW under one atmosphere ambient conditions. Under vacuum an additional power of 3 mW must be supplied to overcome the observed stick-slip friction. Of this 3 mW at least 0.2 mW goes into accelerating electrons to 30 keV so as to generate an average x-ray power of 2 nW. The power going into visible triboluminescence is 10 nW, as shown by the spectrum [FIG. 7].

Although tribocharging has enormous technological applications (McCarty, L. Whitesides, G. M. Electrostatic charging due to separation of ions at interfaces: contact electrification of ionic electrets. *Angew. Chem. Int. Ed.* 47, 2188-2207 (2008)) its physical origin is still in dispute. In one view tribocharging of insulators involves the statistical mechanical transfer of mobile ions between surfaces as they are adiabatically separated (Harper, W. R. *Contact and Frictional Electrification* (Laplacian Press, Morgan Hill, Calif., 1998)). A competing theory (Deryagin, B. V. Krotova, N. A. Smilga, V. P. *Adhesion of Solids* (Consultants bureau, New York, 1978)) proposes that a charged double layer is formed by electron transfer across the interface of dissimilar surfaces in contact. When these surfaces are suddenly pulled apart the net charge of each layer is exposed. We have observed two time scales in dynamic tribocharging. One is the long time scale over which average, charge densities of about $10^{10}$ e/cm$^2$ are maintained on the tape. In addition, there exists a process that concentrates charge on a transient time scale of the order of a nanosecond to reach densities that are about 100 times larger than the average value. The physical process whereby such a large concentration of charge is attained involves the surface conductivity of the tape. This conductivity could be provided by mobile ions (McCarty, Whitesides, G. M. Electrostatic charging due to separation of ions at interfaces: contact electrification of ionic electrets. *Angew. Chem. Int. Ed.* 47, 2188-2207 (2008)) or perhaps via precursor discharges stirring up the surface of the peeling tape. We propose that x-ray emission will yield insight into this and other fundamental aspects of tribology.

Figure 8:
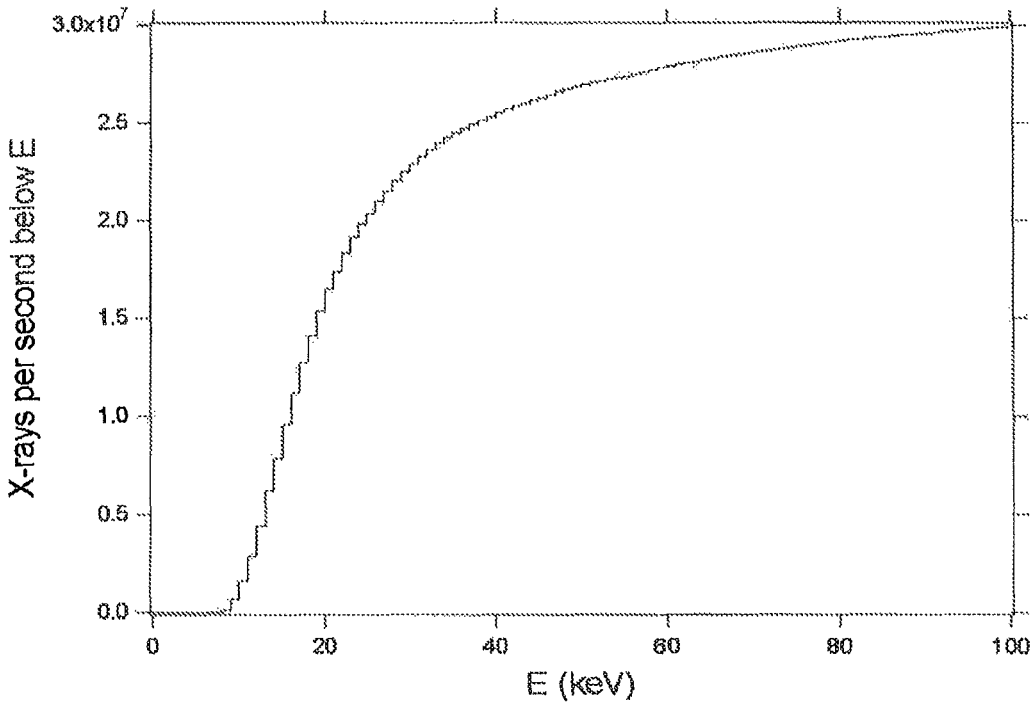
FIG. 8 shows integrated x-rays per second emitted from peeling tape at 20 cm/s under $1\times10^{-3}$ torr of air. The data was obtained with an Amptek XR-100 3-Stack x-ray detector placed at 90 cm from the tape looking through a ¼" plastic window. This detector has an active area of 25 $mm^2$. The data is corrected for $2\pi$ solid angle and an integration time of 60 s.
Figure 9:
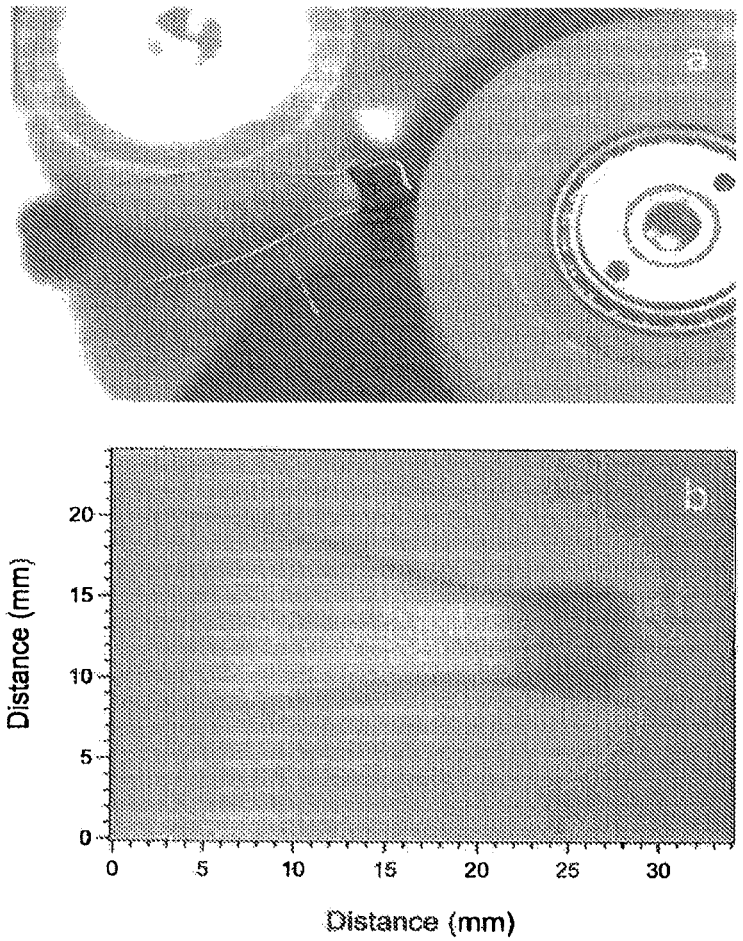
FIG. 9 shows an x-ray image of a capacitor taken with peeling tape as the x-ray source according to an embodiment of the current invention.
Figure 10:
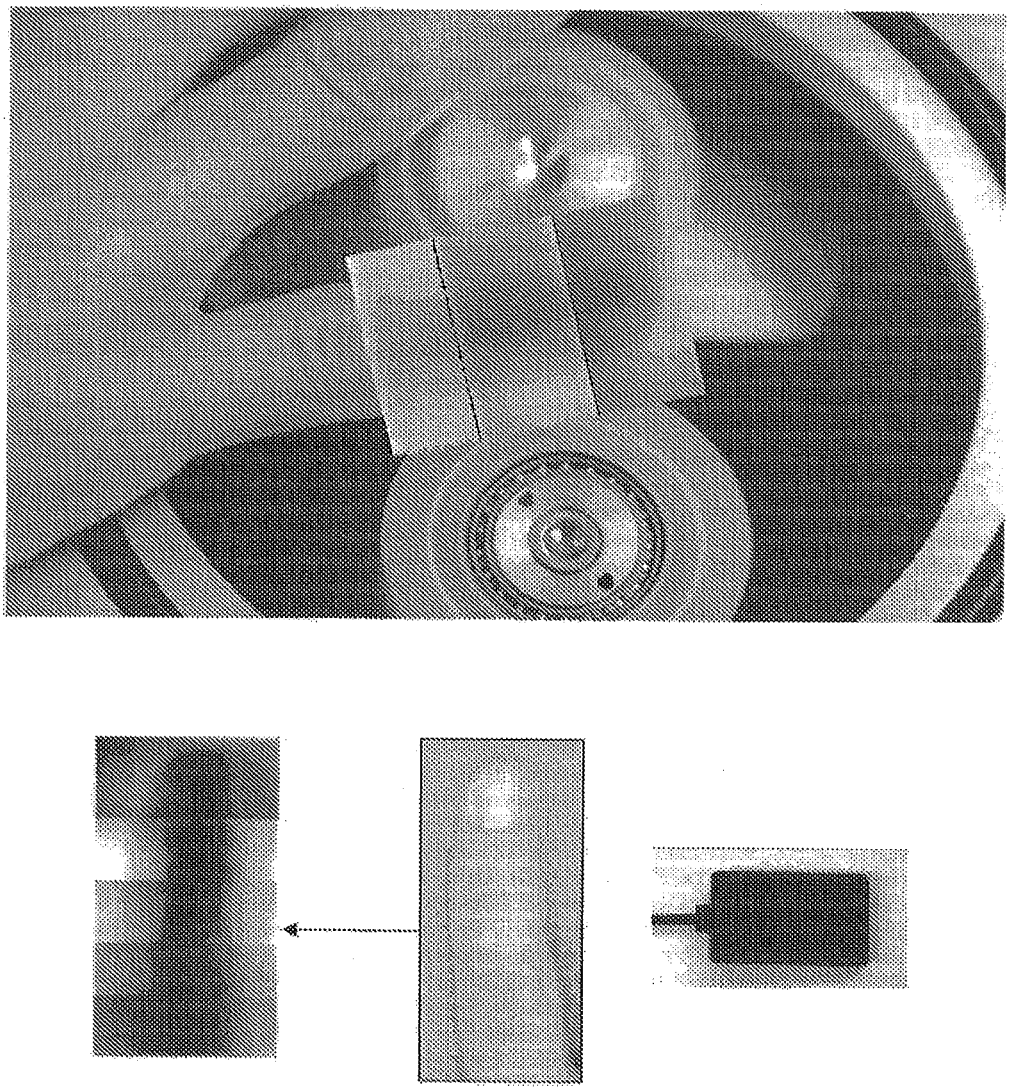
FIG. 10 shows x-ray images of a human finger taken with peeling tape according to an embodiment of the current invention. Top panel, 3 x-ray images taken with 20 s exposures on a Hamamatsu oral x-ray camera [S8985-02] were combined and overlaid on a picture of the set up used. The tape was peeled from bottom to top at a speed of 10 cm/s under $1\times10^{-3}$ torr of air. The hand was placed over a ¼" plastic window at about 1 cm from the tape. The bottom sequence shows from left to right, x-ray image of the human finger, photograph of the human finger, and the x-ray camera used to take the x-ray images.

The intensity of emission is sufficiently strong (see FIG. 8) as to make peeling tape useful as a source for x-ray photography according to some embodiments of the current invention, Examples of x-ray photos are provided in FIG. 9 and FIG. 10. The correlation displayed in FIG. 4 has a resemblance to the geophysical effect called earthquake lights (Freund, F. Sornette, a Electro-magnetic earthquake hursts and critical rupture of peroxy bond networks in rocks. *Techtonophysics* 431, 33-47 (2007)) whereby stress-induced charge liberation during earthquakes generates electromagnetic radiation. The macroscopic physical processes which spontaneously organise an off-equilibrium throughput of low-energy density into x-ray emission suggest looking for this phenomenon in systems that display stick-slip friction (Budakian, R. Weninger, K. Hiller, R. A. Futterman, S. J. Picosecond discharges and stick-slip friction at a moving meniscus of mercury on glass. *Nature* 391, 266-268 (1997); Dickinson, J. T. et al. Dynamical tribological probes: particle emission and transient electrical measurements, *Tribology Lett.* 3, 53-67 (1997)), fractoluminescence (Eddingsaas, N. C. Suslick, K. S. Light from sonication of crystal slurries. *Nature* 444, 163 (2006)), triboluminescence (Walton, A. J. Triboluminescence. *Adv. in Phys.* 26, 887-948 (1977)) and gecko-mimetic adhesion (Autumn, K. et al. Adhesive force of a single gecko foot-hair. *Nature* 405, 681-685 (2000)). The charge density realised in these experiments is about the same value as the effective charge that accumulates on the surface of pyroelectric crystals used to generate table top nuclear fusion (Naranjo, B. Gimzewski, J. K. Putterman, S. Observation of nuclear fusion driven by a pyroelectric crystal, *Nature* 434, 1115-1117 (2005)).

All experiments were carried out with off-the-shelf rolls of Photo Safe 3M Scotch Tape [19 mm×25.4 m] that were secured to a precision ball bearing mounted on a stage supported by two very stiff steel spring leaves (with spring constant $6.6\times10^3$ N/m+/−$3\times10^2$ N/m), FIG. 3C. The displacement of the leaves from their equilibrium position was measured with a commercial inductor position detector [Baumer Electric] with resolution 505 μm/V. A free portion of the tape was stuck to a cylinder connected to a rotating motor, and the whole set up was placed in a vacuum chamber. All x-ray data was acquired at a pressure of $1\times10^{-3}$ torr and at a peel speed of ~3 cm/s. X-ray energy emissions were recorded with Amptek [XR-100T 3-stack and XR-100 CdTe] detectors and with 5" diameter by 5" long Bicron 501A liquid scintillators coupled to Hamamatsu 5" photomultiplier tubes [R1250] (Naranjo, B. Gimzewski, J. K. Putterman, S. Observation of nuclear fusion driven by a pyroelectric crystal. *Nature* 434, 1115-1117 (2005)). Radio frequency signals were recorded with antennas made of the exposed inside conductor of BNC cables placed within millimeters of the peeling point. All data was digitized and saved to disk for off line analysis detailed in the Methods section. The spectrum of visible photons [FIG. 7] was taken with a grating spectrometer [Acton Research 300i] coupled to an intensified camera [Princeton Instruments] and is corrected for the response function of the instrument.

Methods

FIG. 3A and FIG. 3B are 15 s exposures on a Cannon EOS 10D. The electron scintillator visible in the forefront of these images is a Kimball Physics C5X5-R1000. The data shown in FIG. 4A, was taken with a National Instruments PXI-5122 14 bit digitizer at 10 points per μs. The ~80 Hz oscillations on the force measurement correspond to the resonance frequency of the loaded spring. We note that although our data clearly shows stick-slip motion, our peel speed of 3 cm/s is much lower than what is referred to in the literature as the stick-slip regime for peeling pressure sensitive adhesive tape (Collet, P. P. Ciccotti, Vanel, L. Imaging the stickslip peeling of an adhesive tape under a constant to ad. *J. of Stat. Mech.* 3, 3005 (2007)). The radio frequency emission was recorded using a BNC chassis mount placed about 1 cm from the peel line terminated with 500Ω [red upper trace] displayed in arbitrary units. For this figure the Amptek x-ray detector [XR-100T 3-stack] was placed about 5 cm from the peeling interface and its Beryllium window was shielded with a 25 μm thick tantalum foil to prevent saturation. This detector has a background of about one count every 3 s from 5 keV to 400 keV (FIG. 6) and pileup cannot be discriminated for events under 600 ns. The possibility of pileup affecting spectral data also challenges efforts to resolve x-ray energy emission from lightning bolts where similar energy scales are detected (Dwyer, J. R. et al. Energetic radiation produced during rocket-triggered lightning. *Science* 299, 694-697 (2003)). The x-ray data in FIG. 4B was acquired by a Hamamatsu 5" photomultiplier [R1250] looking at 5" diameter by 5" long Bicron 501A liquid scintillator (Naranjo, B. Gimzewski, J. K. Putterman, S. Observation of nuclear fusion driven by a pyroelectric crystal. *Nature* 434, 1115-1117 (2005)) and recorded by an Infinium Oscilloscope at 8 Gs/s [1.5 GHz bandwidth]. The units in the scintillator axis are keV electron equivalent per ns, and reference the calibration performed with several Compton edges from different radioactive sources (Naranjo, B. Oimzewski, J. K. Putterman, S. Observation of nuclear fusion driven by a pyroelectric crystal, *Nature* 434, 1115-1117 (2005)). The centre of the scintillator was placed 15 cm from the peeling tape outside the vacuum chamber looking through a 2 cm quartz window. In this figure the antenna is 5 mm of exposed inside wire of a BNC cable terminated with 50Ω. The relative timing of the signal has been corrected for the 54 ns transit time of the photomultiplier and the 3 ns length of the antenna. The characteristic rise time of the scintillator-photomultiplier arrangement can be determined by capturing a high energy cosmic ray [dashed blue trace] and is seen to be about 5 ns, the same as for the x-ray pulse. The sub-ns pulse [dashed red line] used to calibrate the antenna is generated by charge transfer between mercury and glass in relative motion (Budakian, R. Weninger, K. Hiller, R. A. Putterman, S. J. Picosecond discharges and stickslip friction at a moving meniscus of mercury on glass. *Nature* 391, 266-268 (1997)). Further studies of the timescales for discharge (Baksht, R. B. Vavilov, S. P. Urbayaev, M. N. Duration of the x-ray emission arising in a vacuum discharge. *Izvestiya Uchebnylch Zavedenii Fizika* 2, 140-141 (1973); Mesyats, G. A. Nanosecond x-ray pulses. *Sov. Phys. Tech. Phys.* 19, 948-951 (1975)) could yield insight on the mechanisms at play.

The x-ray spectrum shown in FIG. 5 was obtained from unwinding an entire roll of tape at between 3 cm/s and 3.6 cm/s, which took about 700 seconds. The data was acquired with a solid state x-ray detector [Amptek 100-XR. CdTe] unshielded, placed outside the vacuum chamber at 69 cm from the peeling tape and looking through a ¼" plastic window. This detector has an active area of 25 $mm^2$, is 100% efficient from 10 keV to 50 keV and has a background count rate of ~1 count per 100 seconds. The data was digitized with a National Instruments PXI-5122 board at a rate of 1 s every 1.9 s for a total of 364 s. The inset in FIG. 5 is the frequency of emission of nanosecond long x-ray pulses as a function of the total pulse energy generated during the same unwinding. An x-ray pulse was deemed valid if a coincidence within 10 ns was recorded between the radio frequency antenna and the liquid scintillator [Bicron 501A], and within 2 μs of a signal on an unshielded Amptek solid state detector [XR-100 3-Stack] with more than 10 keV. All the Amptek coincidences are however found within a 400 ns window, which we believe is the limit of the internal electronics of the device. The antenna was 5 mm of exposed inside conductor of a regular BNC cable terminated with 50Ω placed 5 mm from the peel line. The x-ray detectors were placed outside the chamber looking through a ¼" plastic window, the Amptek 3-Stack at 40 cm from the tape and the Scintillator at 76 cm. Coincidence data was digitized at 1 GSa/s with an Acqiris board [DC270] (Naranjo, B. Gimzewski, J. K. Putterman, S. Observation of nuclear fusion driven by a pyroelectric crystal, *Nature* 434, 1115-1117 (2005)) triggered on the antenna signal. The dead time of these acquisitions was less than 20 s for the 700 s run, and the background coincidences were found to be 0 for a 1000 s wait.

Figure 7:
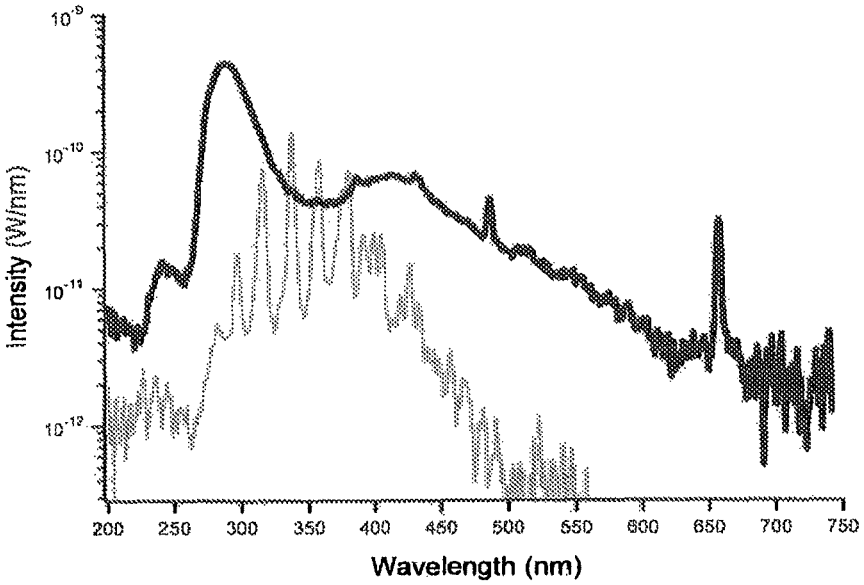
FIG. 7 shows light spectra from peeling tape. The black trace was taken at $1\times10^{-4}$ torr of air and the grey dashed trace at atmospheric pressure. The nitrogen lines which are prominent in air at one atmosphere are indicative of a gas discharge, which, is typical of other processes such as fracto-luminescence and lightning. At low pressure the N lines are overshadowed by a process which leads to broad band emission with hydrogen lines.

The visible spectrum at room pressure in FIG. 7 shows lines which are indicative of gas discharge, also observed in fracto-luminescence (Eddingsaas, N. C. Suslick, K. S, Light from sonication of crystal slurries. *Nature* 444, 163 (2006)) and lighting (Orville, E. R. Henderson, R. W. Absolute spectral measurements of lightning from 375 to 880 nm. *J. of the Atm. Sciences* 41, 3180-3187 (1984)). At low pressure, the nitrogen lines are overshadowed h a process which leads to broad band emission with hydrogen lines.

X-Ray Emission Correlated with Stick Slip Friction and Brittle Fracture

Figure 11:
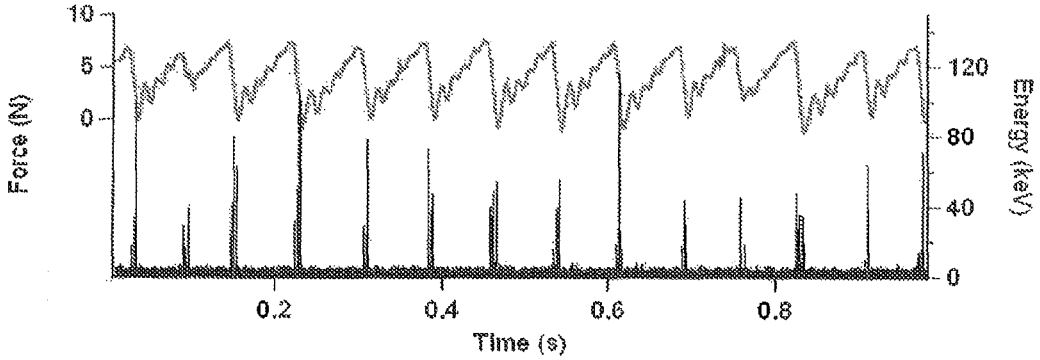
FIG. 11 shows correlation between slip events and x-ray emission from peeling tape according to an embodiment of the current invention. The top trace is the force (red) and the bottom peaks are x-ray pulses recorded with a solid state x-ray detector [Amptek XR-100CdTe]. The stick slip motion observed here is similar to brittle fracture; between slips the tape is not peeling. The ringing after each slip has the period of the spring mount holding the roll of tape.

The apparatus shown in FIG. 3C according to an embodiment of the current invention can be used to measure the force required to peel tape simultaneously with the x-ray emission, as shown in FIG. 11.

Short Range Low Power X-Ray Communications

Figure 12:
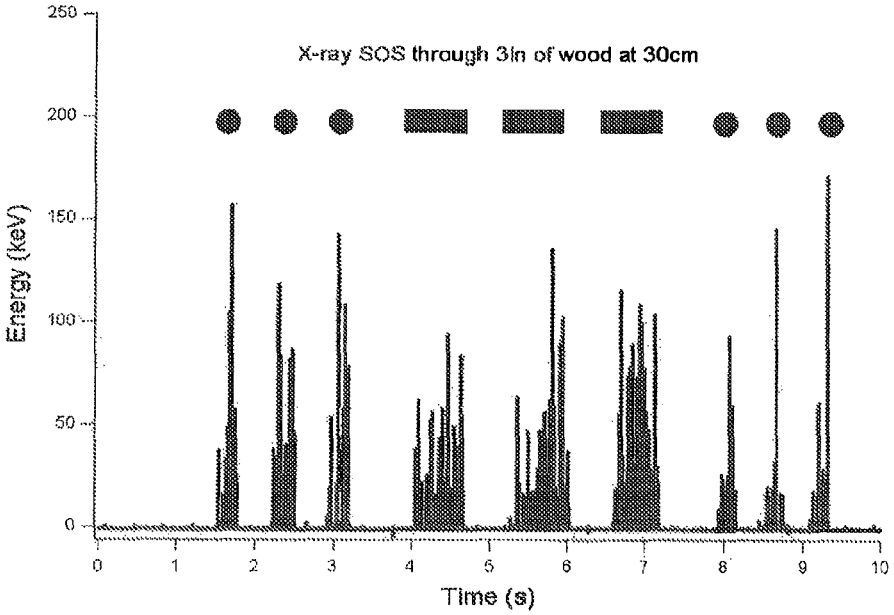
FIG. 12 shows an x-ray SOS signal generated by controlling the peeling of a roll of tape according to an embodiment of the current invention.

Separating adhesives on command can be used as a low power modulated x-ray source for x-ray communications. A system such as the one shown in FIG. 2 is suitable for this purpose. FIG. 12 shows an example of x-ray communications driven by x-ray triboluminescence from peeling tape.

Electron Radiation Therapy

The high energy electron current which generates x-rays is $10^5$ times greater than the x-ray flux according to some embodiments of the current invention. With an appropriate window, this electron radiation can be used for therapy. A miniaturized device according to some embodiments of the current invention would allow localized high energy electron radiation therapy throughout the body. Realizing that a Gray [=1·mJ/cc] is the standard unit of a dose of therapeutic radiation, we make the stunning observation that the electron emission from our system can deliver 1 Gray/sec when referenced to a 1 $cm^3$ target.

Prediction of Failure and Fatigue

Figure 13:
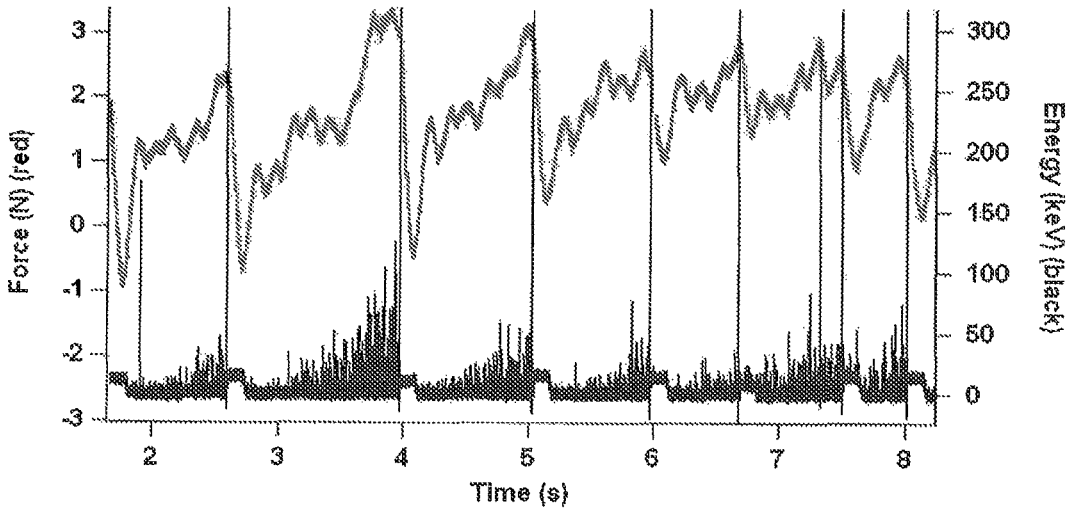
FIG. 13 shows x-ray emissions (black) and force (red) from peeling tape. X-ray emissions can be observed preceding a slip of the force where a much larger event takes place and in this case saturates the detector resulting in a step in the base level.
Figure 14:
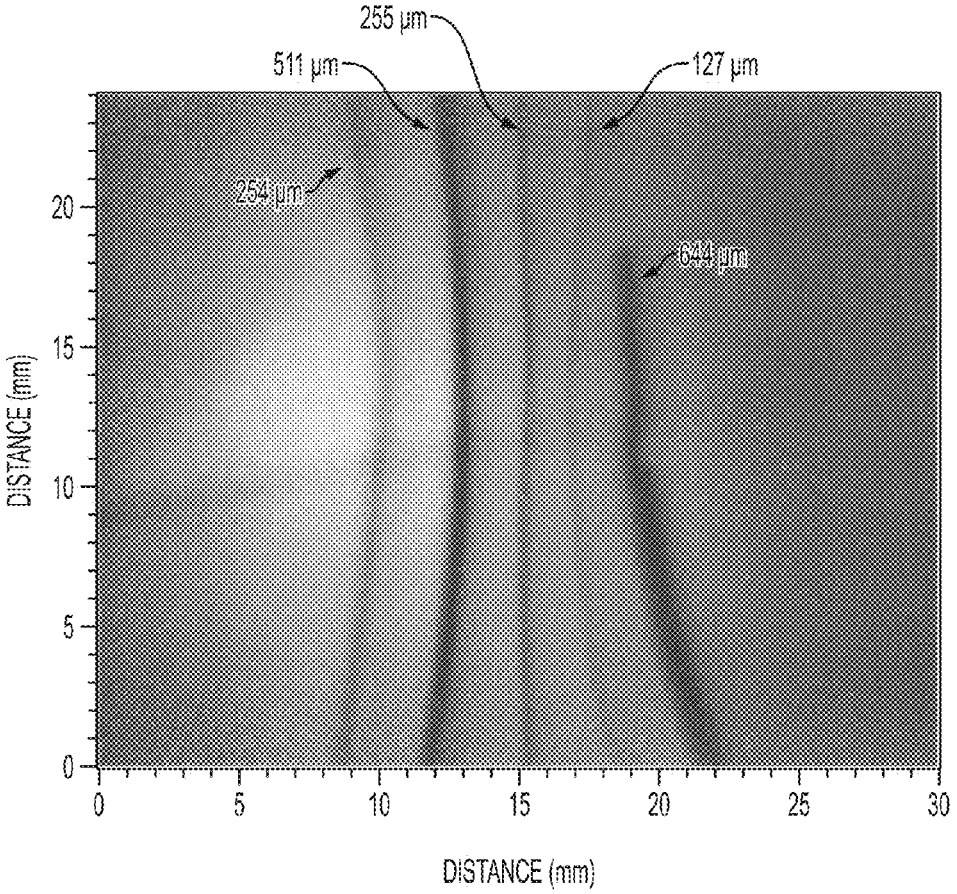
FIG. 14 shows x-ray images of metal wires according to an embodiment of the current invention.

Using the apparatus of FIG. 3C, it is possible to observe emission of x-rays before a slip event, FIG. 13. Characterizing the nature of this 'pre-emission' could yield a prediction of slip events [i.e. failure] in composite materials and earthquakes (F. Freund, D. Sornette, *Electro-magnetic earthquake*

*bursts and critical rupture of peroxy bond networks in rocks*. Techtonophysics 431, 33-47 (2007)).

In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A radiation source, comprising:

a contact element;

a surface element arranged proximate said contact element; and a mechanical assembly operatively connected to at least one of said contact element and said surface element, wherein said mechanically assembly is operable to at least separate said contact element from said surface element, wherein at least some mechanical energy is supplied from said mechanical assembly while in operation to generate radiation while said contact element and said surface element are separated, and wherein said radiation source has a maximum dimension less than about 1 cm.

2. A radiation source according to claim 1, wherein said radiation source has a maximum dimension less than about 1 mm.

3. A radiation source according to claim 1, wherein said mechanical assembly comprises a piezoelectric transducer.

4. A radiation source according to claim 1, wherein said radiation generated by said radiation source comprises charged particles.

5. A radiation source according to claim 1, wherein said radiation generated by said radiation source comprises electrons.

6. A radiation source according to claim 1, wherein said radiation generated by said radiation source comprises electromagnetic radiation.

7. A radiation source according to claim 1, wherein said radiation generated by said radiation source comprises x-rays.

8. A medical device comprising a radiation source according to claim 1.

9. A medical device according to claim 8, wherein said medical device has a portion containing said radiation source that is surgically insertable or is insertable within an orifice of a subject such that said radiation source can be brought into proximity to an internal region of said subject.

* * * * *